United States Patent [19]

King et al.

[11] Patent Number: 4,534,655

[45] Date of Patent: Aug. 13, 1985

[54] PROPORTIONING DEVICE

[75] Inventors: L. Tony King; Mark W. Peters, both of Long Beach, Calif.

[73] Assignee: Komax Systems, Inc., Long Beach, Calif.

[21] Appl. No.: 653,194

[22] Filed: Sep. 24, 1984

[51] Int. Cl.[3] ..... B01F 5/10; B01F 15/02

[52] U.S. Cl. ..... 366/137; 366/142; 366/165

[58] Field of Search ..... 366/136, 137, 138, 142, 366/159, 165, 167, 173, 174, 176, 182, 336, 337, 338

[56] References Cited

U.S. PATENT DOCUMENTS

| | | | |
|---|---|---|---|
| 1,160,848 | 11/1915 | Conklin . | |
| 1,445,427 | 2/1923 | Werner . | |
| 2,105,165 | 1/1938 | Schnelz . | |
| 2,863,465 | 12/1958 | Shoemaker et al. . | |
| 2,868,516 | 1/1959 | Moseley . | |
| 2,997,373 | 8/1961 | Stephens . | |
| 3,565,404 | 2/1971 | Reid | 366/137 |
| 3,741,533 | 6/1973 | Winn | 366/136 |
| 3,762,689 | 10/1973 | Hege | 366/136 |
| 4,007,921 | 2/1977 | Zingg . | |
| 4,325,642 | 4/1982 | Kratky | 366/137 |

*Primary Examiner*—Robert W. Jenkins

*Attorney, Agent, or Firm*—Limbach, Limbach & Sutton

[57] ABSTRACT

A device for maintaining a substantially uniform proportion between two or more liquids comprising a substantially cylindrically shaped tank and a liquid exit tube located at the bottom and approximately at the radial center of the tank. The liquid exit tube is characterized as possessing a flared top end and one or more openings at its bottom end. Means are also included within the cylindrically shaped tank for injecting two or more liquids into the tank which is connected to a pump or other means for maintaining circulation of the liquids.

11 Claims, 1 Drawing Figure

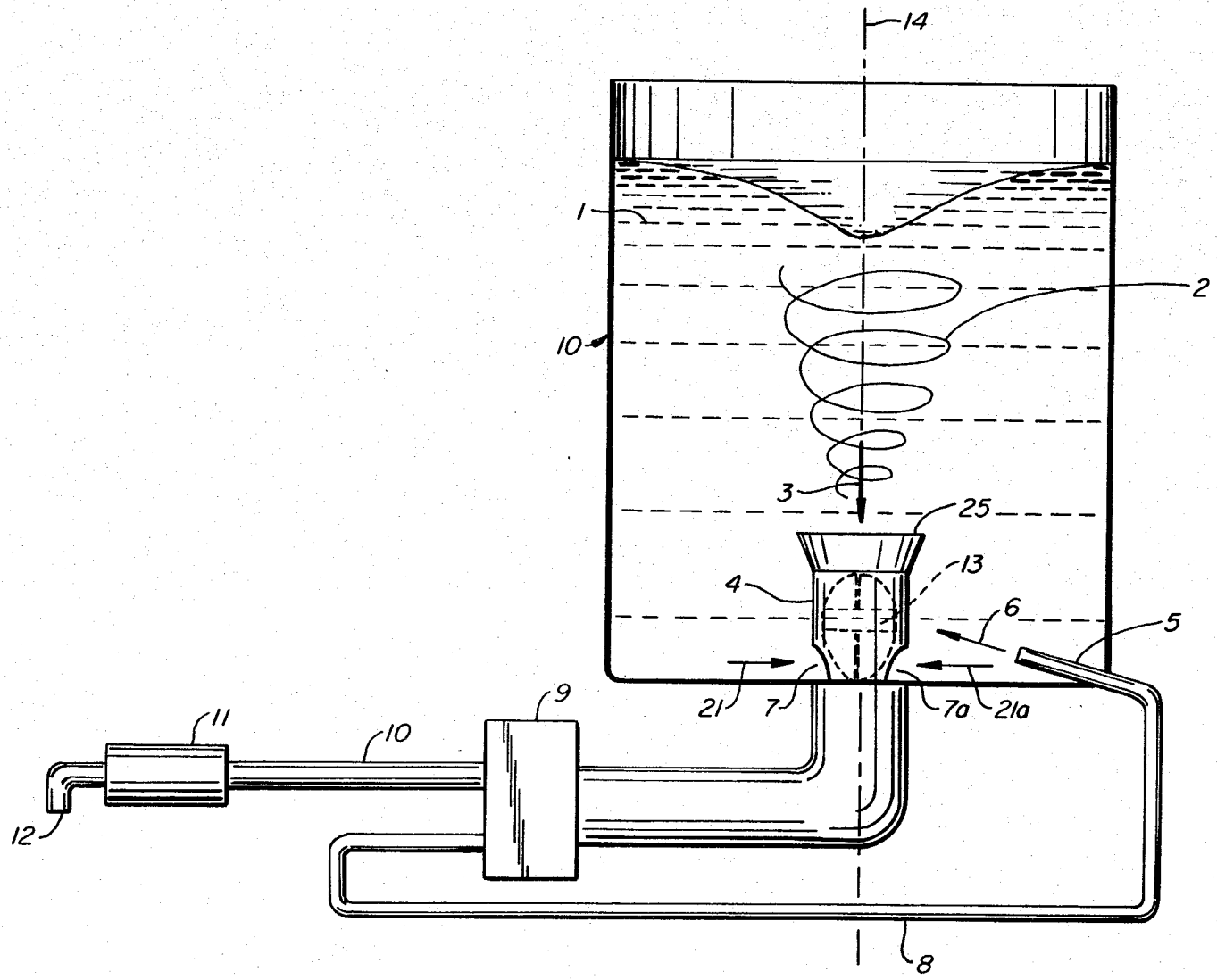
14
1
10
2
3
25
4
13
6
5
21
7
7a
21a
9
10
11
12
8

PROPORTIONING DEVICE

TECHNICAL FIELD OF INVENTION

The present invention deals with a means for maintaining a substantially uniform proportion between two or more liquids. The device is particularly useful in maintaining a substantially uniform proportion between two liquids which are immiscible in one another, such as oil and water.

BACKGROUND OF THE INVENTION

There are certain instances where it is absolutely crucial that a correct and accurate proportion between two or more liquids is maintained, which is not easily accomplished particularly when the liquids are immiscible in one another. As an example of a use to which such a device can be made is in the determination of the amount of water in crude oil, particularly as it is transported and stored in present day super-tankers.

As oil prices have escalated in recent years, oil companies have sought more effective methods of determining the true "bottom sediment and water" content, commonly called BS&W, in the oil they purchase. BS&W comes from a variety of sources in the oil ranging from water and sediment pumped up from the bottom of an oil well to sea water taken on board a ship during the sea voyage which is used as ballast. Since the purchaser pays for the oil based on total volume received, it becomes important to know what percentage of the shipment is BS&W.

In calculating the BS&W, the purchaser follows a well accepted procedure of withdrawing a small sample of the oil unloaded from the super-tanker every few seconds. This sample is put into a small tank and, every few days, or as the tank becomes full, the contents of the tank are mixed and a small sample taken from it for analysis for BS&W content. Often, even though the sampling process is accurate, the method of mixing the tank full of oil and water is ineffective, leading to inaccurate analyses. Since an entire ship load averaging some 450,000 barrels will be analyzed on the basis of 12½ to 25 mls. of sample oil, a small error of, for example, 0.1% can lead to a sizeable difference in the value of the cargo ($11,700 based on a 0.1% error at oil selling for $26.00 per barrel). Unfortunately, prior to the present invention, there has appeared to be no accurate means of maintaining uniform proportion between two or more liquids, such as crude oil and water, to insure the accuracy of the sampling analysis as described above.

It is thus an object of the present invention to provide such a device capable of maintaining a substantially uniform proportion between two or more liquids at a speed and accuracy unavailable by prior devices.

BRIEF DESCRIPTION OF THE DRAWING

This and other objects of the present invention will be more fully appreciated when considering the following disclosure and accompanying FIGURE, which is a plan elevational view of the device of the present invention.

SUMMARY OF THE INVENTION

The present invention deals with a device for maintaining a substantially uniform proportion between two or more liquids. The device comprises a substantially cylindrically-shaped tank for maintaining said liquids, a liquid exit tube characterized as being located at the bottom and at approximately the radial center of the cylindrically-shaped tank, said liquid exit tube being further characterized as possessing a flared top end and one or more openings at its bottom end and means located within the liquid exit tube for the substantial elimination of the formation of a vortex. Means are further included within the cylindrically shaped tank for injecting two or more liquids into the tank at a direction between approximately 0° to 45° above horizontal and approximately perpendicular to the radius of the cylindrically shaped tank. Means are included for circulating the two or more liquids from and back into the cylindrically shaped tank as well as for withdrawing a sample of the two or more liquids in a proportion substantially identical to the proportion of said liquids in the tank.

DETAILED DESCRIPTION OF THE INVENTION

Referring to the appended FIGURE, cylindrically shaped tank 10 is shown containing liquid 1 which, in keeping with the illustration as presented above, can be two immiscible liquids such as crude oil and water. In practice, the two or more liquids are placed within tank 10 and circulation commenced by actuating pump 9. Liquid is drawn through the mouth of liquid exit tube 4 in the direction of arrow 3 causing vortex formation 2. Vortex elimination means 13 is placed within liquid exit tube 4 for suppressing the vortex prior to or within the liquid exit tube. In the preferred embodiment, this is accomplished by employing single elements of a KOMAX motionless mixer as illustrated in U.S. Pat. No. 3,923,288. As such, substantial amounts of air are kept from pump 9, thus greatly reducing cavitation within the pump and extending the pump life considerably.

Further within liquid exit tube 4 is located one or more openings at its bottom end, as illustrated as 7 and **7*a* of the FIGURE. Upon the actuation of pump 9, liquid is drawn within liquid exit tube 4 through these one or more openings as shown by directional arrows 21 and 21*a*. Ideally, four equally spaced holes are provided within the body of liquid exit tube 4** which, in the case of a crude oil and water mixture, should be approximately 0.75 times the internal cross-sectional area of the vortex tube.

Once liquid 1 is withdrawn as described above, it then can be recirculated by pump 9 through recirculation tube 8 and re-injection within tank 10 via injection means 5. The injection means, injecting liquid in the direction as illustrated by arrow 6, should be oriented between approximately 0° and 45° above horizontal and, most preferably, at approximately 15° above horizontal. Further, injection means 5 is oriented such that the tube points in a direction approximately perpendicular to the radius of cylindrically shaped tank 1.

Liquid exit tube 4 is provided at a location approximately coincident with radial center 14 of the cylindrically shaped tank. The liquid exit tube is further characterized as possessing flared top 25 which performs the function of maintaining vortex 2 approximately coincident, again, with radial center line 14, which, together with the other functional aspects of the present invention greatly aids in the maintenance of a uniform proportion of liquids within tank 10 as more fully described below.

In practice, once pump 9 is actuated, a number of events occur resulting in the maintenance of a uniform proportion between liquids 1. Firstly, liquid is drawn in the direction of arrow 3 within exit tube 4. Because of the formation of vortex 2, the liquid entering flared top 25 basically comes from the top 30% of the cylindrical tank. Simultaneously, liquid is withdrawn from the cylindrical tank via openings 7 and 7*a*, which liquid naturally is withdrawn from the bottom portion of liquid body 1. Thus, an effective means of withdrawing liquid from both the top and bottom portions of cylindrical tank 10 is disclosed, which would result in the feeding of both liquid components to pump 9 in a two component crude oil/water mixture.

Until a steady state is reached, all of the liquid withdrawn through liquid exit tube 4 is recirculated via line 8 back into cylindrical tank 10. Injecting means 5 is preferably situated, as described above, such that the reinjected liquid proceeding in the direction of arrow 6 strikes the inner wall of cylindrical tank 10 resulting in a "cleansing" action to take place and to reinforce the establishment of vortex 2. To aid in cleansing, the inner wall of tank 10 can be coated with a thin layer of a friction reducing material, such as polytetrafluoroethylene, available under the trademark TEFLON by E. I. DuPont de Nemours & Co.

Once a steady state is reached, which takes approximately 180 seconds in the typical crude oil/water mixture, a sample can be withdrawn. Ideally, the liquid being withdrawn via line 8 can be passed through motionless mixer 11 of a design as provided in U.S. Pat. No. 3,923,288. Thereupon, the finally mixed liquid can be extracted from the system at line 12 for testing. Once the solid state is reached, the invention as presented above is capable of insuring that the liquid withdrawn at line 12 will have the virtually identical proportionality between components as the body liquid 1 found within cylindrical tank 10.

When liquid 1 is comprised of a crude oil/water mixture, optimum results are achieved by angling liquid injection tube 5 at approximately 15° above horizontal and positioning the injection tube to pass through the cylindrically shaped tank at its base approximately three quarters of the distance from the center line to the side wall of the tank. By providing four openings at the base of liquid exit tube 4 (depicted in the FIGURE as openings 21 and 21*a*) which cumulatively possess an area equal to approximately 0.75 times the internal cross-sectional area of the exit tube, liquid is withdrawn simultaneously from approximately the top 30% and bottom 30% of the body liquid 1 found within cylindrical tank 10.

Although the above-recited configuration can be employed for the proportioning of virtually any liquids, whether miscible or immiscible, the above-recited quantitative values have been selected to maximize the use of the present system in a crude oil/water system. Naturally, if other liquid systems were to be employed with the device of the present invention, the relative sizes and orientation of the various components could be altered to again insure a proper proportioning at exit tube 12.

We claim:

1. A device for maintaining a substantially uniform proportion between two or more liquids comprising:

a substantially cylindrically shaped tank for maintaining said liquids;

a liquid exit tube characterized as being located at the bottom and at approximately the radial center of said cylindrically shaped tank, said liquid exit tube being further characterized as possessing a flared top end and one or more openings at its bottom end;

means located within said liquid exit tube for the substantial elimination of the formation of a vortex at the downstream end of said liquid exit tube;

means for injecting said two or more liquids into said cylindrically shaped tank at a direction between approximately 0° and 45° above horizontal and approximately perpendicular to the radius of the cylindrically shaped tank;

means for circulating said two or more liquids from and back into said cylindrically shaped tank; and means for withdrawing a sample of the two or more liquids in a proportion substantially identical to the proportion of said liquids in said cylindrically shaped tank.

2. The device of claim 1 wherein said injecting means comprises a tube located proximate the bottom of said cylindrically shaped tank whose orientation is between approximately 0° and 45° above horizontal.

3. The device of claim 2 wherein the orientation of said tube is approximately 15° above horizontal.

4. The device of claim 2 wherein said tube passes through said cylindrically shaped tank at its base approximately three quarters of the distance from its center line to the side wall of the tank.

5. The device of claim 1 wherein said liquid exit tube is flared at its top end a sufficient amount to maintain any vortex which forms from said two or more liquids within said cylindrically shaped tank at approximately the axis of said tank.

6. The device of claim 1 wherein said openings at the bottom of the liquid exit tube comprise four holes equally spaced within the side wall of the exit tube.

7. The device of claim 1 wherein said openings at the bottom of the liquid exit tube cumulatively possess an area equal to approximately 0.75 times the internal cross-sectional area of said exit tube.

8. The device of claim 1 wherein said liquids comprise crude oil and water.

9. The device of claim 1 which further comprises a motionless mixer located proximate said withdrawal means.

10. The device of claim 1 wherein liquid from approximately the top 30% and bottom 30% of said two or more liquids in said cylindrically shaped tank are withdrawn by said liquid exit tube and circulated by said circulating means.

11. The device of claim 1 wherein the interior of said cylindrically shaped tank is coated with a film of polytetrafluoroethylene.

* * * * *